United States Patent [19]

Larson

[11] 4,110,656

[45] Aug. 29, 1978

[54] METHOD FOR MOUNTING ELECTRODES IN HIGH PRESSURE SODIUM LAMPS AND RESULTING ARTICLE

[75] Inventor: Daniel A. Larson, Cedar Grove, N.J.

[73] Assignee: Westinghouse Electric Corp., Pittsburgh, Pa.

[21] Appl. No.: 758,978

[22] Filed: Jan. 13, 1977

[51] Int. Cl.[2] ..... H01J 5/50

[52] U.S. Cl. ..... 313/331; 313/217; 174/50.64; 313/332

[58] Field of Search ..... 313/217, 218, 331, 332, 313/252, 285; 174/50.64

[56] References Cited

U.S. PATENT DOCUMENTS

| | | | |
|---|---|---|---|
| 2,966,607 | 12/1960 | Thouret | 313/217 X |
| 3,872,341 | 3/1975 | Werner et al. | 313/217 |
| 3,959,682 | 5/1976 | Wesselink et al. | 313/217 |
| 4,002,939 | 1/1977 | Van Bragt | 313/217 |

*Primary Examiner*—Saxfield Chatmon, Jr.
*Attorney, Agent, or Firm*—B. R. Studebaker

[57] ABSTRACT

A method for securing an electrode to the electrode holder in a high pressure sodium discharge lamp and resulting article, which method, involves spot welding a thin niobium, tantalum or titanium wire across the flattened end of the electrode holder and thereafter spot welding the electrode rod to the electrode holder perpendicular to the axis of the thin wire to provide a strong bond between the electrode and the electrode holder.

4 Claims, 7 Drawing Figures

METHOD FOR MOUNTING ELECTRODES IN HIGH PRESSURE SODIUM LAMPS AND RESULTING ARTICLE

BACKGROUND OF THE INVENTION

In the manufacture of the ceramic-bodied arc tube in a high pressure sodium discharge lamp, problems have been encountered in mounting the electrode rod to its mounting support whether that support be a mounting strap or the exhaust tubulation of the lamp. The electrode rod is generally tungsten and it is usually welded to a refractory metal support or alternatively mechanically mounted to the electrode support.

Direct welding of the tungsten rod to the niobium or tantalum electrode support generally provides a poor weld. If insufficient heat is created during the welding process, the tungsten will not bond sufficiently to the refractory metal support. Alternatively, if sufficient heat is generated by the weld, the tungsten rod will become embrittled and, during handling of the lamp may fracture just above the weld point.

Mechanical clamping of the electrode rod to the electrode support apparently does not provide a tight enough grip to prevent loose or wobbly electrode mounts and in some instances variable mounting heights between the electrode and the end cap or end closure of the arc tube body are encountered.

Some success has been accomplished by combining mechanical clamping with welding. Examples of more successful techniques may be found in U.S. Pat. Nos. 3,882,344 and 3,872,341. Even with this combination of mechanical clamping and welding, loose electrodes, poor welds, and embrittled electrode rods have been encountered.

Good electrode mounts can be critical to the performance and longevity of a high pressure sodium discharge lamp and it is therefore important that the interconnection between the electrode rod and its support be both of good quality and consistently reproducible.

SUMMARY OF THE INVENTION

This invention relates to high pressure sodium discharge lamps and more particularly to an improved method for securing the electrode rod to the electrode support and the article produced by that method.

The improved method for bonding the electrode rod to the electrode support or holder in a high pressure sodium discharge lamp involves welding a thin wire selected from the group comprising niobium, tantalum, and titanium to a flattened section of the electrode support or holder adjacent the end thereof and perpendicular to the axis of the electrode and there after welding the electrode to the electrode holder through the thin wire to form a rigid bond between the electrode rod and the electrode support or holder.

This method provides an electrode mount in which a thin metal wire extends across the flattened face or end portion of the electrode support and the electrode rod is welded to the electrode support through the thin metal wire with the axis of the electrode rod being positioned perpendicular to the axis of the thin metal wire.

The interposing of the thin metal wire between the electrode rod and the electrode support provides a good bond between the electrode support and the thin metal wire, and the thin metal wire and the electrode rod without subjecting the electrode rod to temperatures which can cause embrittlement of the tungsten comprising the electrode rod.

BRIEF DESCRIPTION OF THE DRAWING

Many of the attendant advantages of the present invention will become more readily apparent and better understood as the following detailed description is considered in connecting with the accompanying drawing, in which.

DESCRIPTION OF THE PREFERRED EMBODIMENT

Figure 1:
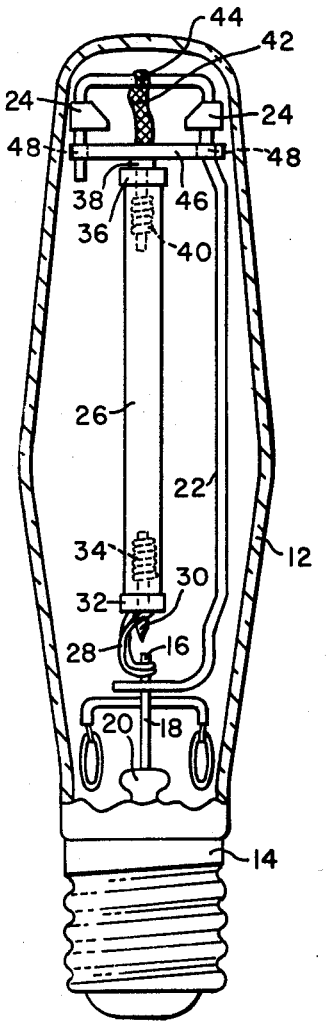
FIG. 1 is a side elevational view partly in section of a typical high pressure sodium discharge lamp.
Figure 2:
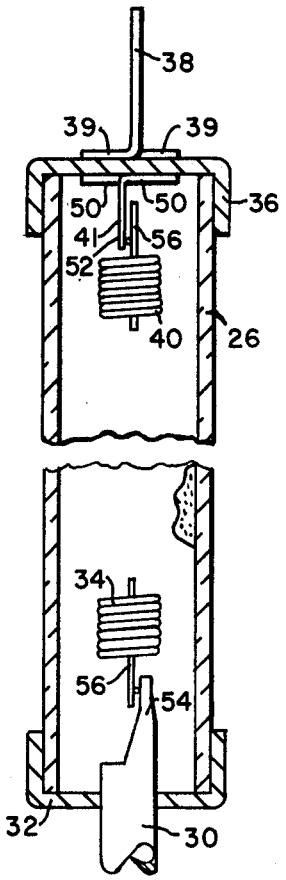
FIG. 2 is an enlarged side elevational view, partly in section, of an arc tube of a high pressure sodium discharge lamp embodying the electrode mount of this invention.
Figure 3:
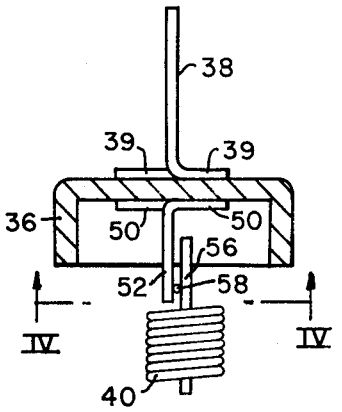
FIG. 3 is a partial sectional view of the upper end cap illustrated in FIG. 2.
Figure 4:
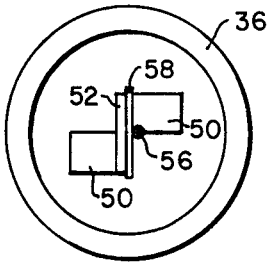
FIG. 4 is a sectional view taken along the line IV—IV of FIG. 3.

Referring now in detail to the drawings wherein like reference characters represent like parts throughout the several views, there is illustrated in FIG. 1 a conventional high pressure sodium discharge lamp employing a typical polycrystalline alumina or sapphire arc tube. The discharge lamp includes an outer envelope 12 of glass attached to a standard metal mogul base 14. A pair of lead-in conductors 16 and 18 (partially superimposed in FIG. 1) are conventionally connected to the mogul base 14 and extend through a reentrant stem press 20 at the base of the envelope 12 in a conventional manner. Mounted on the upper end of the lead-in conductor 18 is the arc tube support frame 22 which serves both to retain and mount the arc tube within the outer envelope 12 as well as to conduct electricity to the upper electrode of the arc tube. The frame 22 is supported at its upper end within the envelope 12 by a pair of resilient spring members 24 which serve to retain the frame 22 in a central location within the outer envelope 12 through resilient contact with the inner surface of the outer envelope.

A conventional polycrystalline alumina or sapphire arc tube 26 is mounted at its lower end to lead-in conductor 16 by means of a flexible wire 31 which encircles the exhaust the fill tubulation 30 of the arc tube and is welded to the lead-in conductor 16 in a manner disclosed in the U.S. Pat. Nos. 3,855,494 for "Ceramic Arc Lamp Construction". The tubulation 30 extends through an end cap 32 at the lower end of the lamp and serves to mount the lower electrode 34 in accordance with this invention.

At the other end of the arc tube 26 is a non-tubulation carrying end cap or end closure 36. An inverted T-shaped lead-in conductor 38 including flange portions 39 is spot welded to the outside of the end cap 36 to provide electrical current to the electrode 40 mounted on the inner side of the end cap 36 by an electrode support element 41. The lead-in conductor 38 is electrically connected to the support frame by the flexible strap 42 at 44. The strap 42 is welded to the lead-in conductor 38 and to the lateral support bar 46 at their juncture. The lateral support bar 46 has channels therethrough at 48 which surround the vertical arms of the support frame 22 to provide for centering of the upper end of the arc tube with respect to the frame but in a manner which will permit longitudinal movement or expansion of the arc tube through the loose sliding fit relationship between the support frame 22 and the channels or apertures 48 and support bar 46.

The electrode support element 41 at the upper end of the lamp as illustrated in the drawings is secured, as for example by welding, to the end cap 36 by oppositely directed foot portions 50 in the same manner as the electrode support element is mounted in U.S. Pat. No. 3,872,341. The difference between that mount and the mount of the present invention is that in place of the U-shaped rod gripping portion disclosed therein the end of the support elements 41 at 52 is flattened to provide a planar surface to which the upper electrode 40 is secured in accordance with the present invention as will be later described.

At the lower end of the arc tube as illustrated in the drawings the tubulation 30 is formed in a manner similar to that disclosed in U.S. Pat. No. 3,882,344, but again, in lieu of the U-shaped rod gripping portion at the end of the tubulation, that portion of the tubulation is flattened as at 54 to provide a flat planar surface to accommodate the electrode weld of this invention. As will be apparent, this tubulation-end cap construction can be employed at both ends of the arc tube if desired.

Each of the electrodes 34 and 40 include an electrode rod 56 to which the coil portion of the electrode is secured in the well-known manner. In mounting the electrode rod 56 to the flattened portions 52 and 54 of the electrode support elements 41 and 30, a thin refractory metal wire is spot welded across the face of the flattened portions 52 and 54 perpendicular to the lamp axis. Thereafter, the electrode rods 54 are spot welded through the thin refractory metal wire 58 to the flattened surface 52 and 54 of the electrode support elements to provide a secure bond between the electrode and the electrode support.

In the preferred embodiment the refractory metal wire is preferably niobium with a diameter of about 20 mils. The support members 41 and 30 are preferably niobium and the electrode rods 56 are of course tungsten. The niobium wire 58 can also be tantalum or titanium although niobium is preferred.

Figure 7:
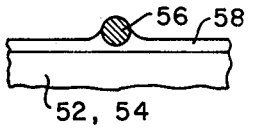
FIG. 7 is an enlarged view illustrating the weld of this invention.
Figure 5:
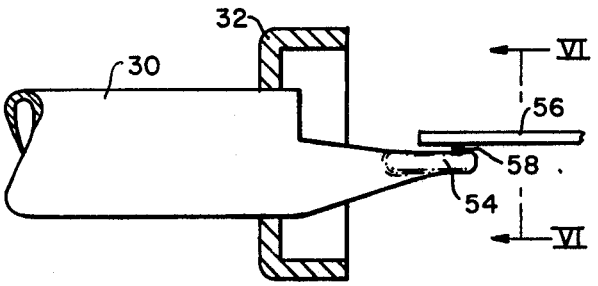
FIG. 5 is a partial sectional view of the lower or tubulation end of the arc tube of FIG. 2.
Figure 6:
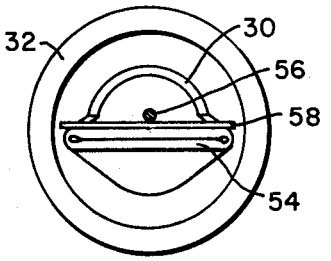
FIG. 6 is a sectional view taken along the line VI—VI of FIG. 5.

In operation, the method of this invention for providing a good tungsten niobium bond between the electrode rod and the electrode support element whether it be exhaust tubulation 30 or the non-tubulation support 41 is accomplished by first spot welding the thin niobium wire to the flattened niobium support in a position perpendicular to the axis of the arc tube. Thereafter, the tungsten support rod of the electrode is spot welded to the flattened portion of the support member in a position along the axis of the arc tube perpendicular to the niobium wire 58. This spot weld provides a good bond to the support member 52, 54 and causes the melting wire 58 to semi-surround the electrode rod 56 and provide an excellent bond therebetween. The ultimate bond provided by the method of this invention is best illustrated in FIG. 7.

What is claimed is:

1. An electrode mount for a high pressure sodium discharge lamp comprising:

an electrode support having a flattened end portion, a thin niobium wire welded to said flattened end portion of said electrode support, and a discharge sustaining electrode including an electrode rod, said electrode rod being welded to said electrode support through said thin metal wire with the axis of said electrode rod positioned perpendicular to the axis of said thin metal wire with said thin metal wire partially surrounding said electrode rod.

2. An electrode mount for a high pressure sodium discharge lamp comprising:

an electrode support having a flattened portion at one end thereof, a thin metal wire selected from the group comprising niobium, tantalum and titanium spot welded to said flattened end portion of said electrode holder perpendicular to the axis of said support, and a discharge sustaining electrode including an electrode rod, said electrode rod being welded to said electrode support through said thin metal wire with the axis of said electrode rod being positioned perpendicular to the axis of said thin metal wire and partially surrounded thereby.

3. A method for bonding the electrode to the electrode support in a high pressure sodium discharge lamp comprising the steps of:

spot welding a thin refractory metal wire selected from the group comprising niobium, tantalum and titanium to a flattened section of the electrode support perpendicular to the axis of said support; and thereafter, spot welding the electrode rod to said electrode support through said thin refractory metal wire with the axis of said electrode rod in a position perpendicular to said thin refractory metal wire thereby causing said thin refractory metal wire to flow and semi-surround said electrode rod.

4. The method according to claim 3 wherein said thin refractory metal wire is niobium, said electrode holder is niobium and said electrode rod is tungsten.

* * * * *